US007160398B2

(12) United States Patent
Kanekiyo

(10) Patent No.: US 7,160,398 B2
(45) Date of Patent: Jan. 9, 2007

(54) METHOD OF MAKING RAPIDLY SOLIDIFIED ALLOY FOR MAGNET

(75) Inventor: Hirokazu Kanekiyo, Kyoto (JP)

(73) Assignee: Neomax Co., Ltd., Osaka (JP)

( * ) Notice: Subject to any disclaimer, the term of this patent is extended or adjusted under 35 U.S.C. 154(b) by 278 days.

(21) Appl. No.: 10/607,435

(22) Filed: Jun. 27, 2003

(65) Prior Publication Data

US 2004/0067154 A1 Apr. 8, 2004

(30) Foreign Application Priority Data

Aug. 8, 2002 (JP) ..... 2002-230802
Feb. 21, 2003 (JP) ..... 2003-044511

(51) Int. Cl.
*H01F 1/057* (2006.01)

(52) U.S. Cl. ..... 148/101; 148/538; 148/541; 148/542; 148/543; 148/548; 164/462; 164/463; 164/475; 164/479; 164/480

(58) Field of Classification Search ..... None
See application file for complete search history.

(56) References Cited

U.S. PATENT DOCUMENTS

H892 H * 3/1991 Walk et al. ..... 164/463
5,291,939 A * 3/1994 Hensley et al. ..... 164/479

(Continued)

FOREIGN PATENT DOCUMENTS

EP 0 040 072 A1 11/1981
EP 0 632 471 A2 1/1995
EP 1 338 359 A1 8/2003
JP 60-15049 1/1985
JP 02-179803 7/1990
JP 02-247304 10/1990
JP 02-247305 10/1990
JP 02-247306 10/1990
JP 02-247307 10/1990
JP 02-247308 10/1990

(Continued)

OTHER PUBLICATIONS

Machine English language translation of Japanese Patent Document No. 11-333549 (Dec. 1999).*

(Continued)

*Primary Examiner*—John P. Sheehan
(74) *Attorney, Agent, or Firm*—Keating & Bennet, LLP

(57) ABSTRACT

A melt of an alloy, represented $(Fe_{1-m}T_m)_{100-x-y-z}Q_xR_yM_z$, where T is Co and/or Ni, Q is B and/or C, R is at least one rare-earth element, M is selected from Al, Si, Ti, V, Cr, Mn, Cu, Zn, Ga, Zr, Nb, Mo, Ag, Hf, Ta, W, Pt, Au and Pb; 10 at %≦x≦35 at %; 2 at %≦y≦10 at %; 0 at %≦z≦10 at %; and 0≦m≦0.5, is prepared. Next, the melt is brought into contact with, and rapidly cooled and solidified by, the surface of a rotating chill roller. The melt is teemed onto a guide member, of which the guide surface defines a tilt angle with a horizontal plane, runs down on the guide surface, and then is fed through at least one tubular hole onto a contact area on the surface of the chill roller.

21 Claims, 4 Drawing Sheets

U.S. PATENT DOCUMENTS

| | | | | |
|---|---|---|---|---|
| 5,690,752 | A * | 11/1997 | Yamamoto et al. | 148/302 |
| 6,676,773 | B1 * | 1/2004 | Kaneko et al. | 148/302 |
| 2002/0036559 | A1 | 3/2002 | Waki et al. | |
| 2002/0117235 | A1 | 8/2002 | Kanekiyo et al. | |
| 2003/0136468 | A1 * | 7/2003 | Kanekiyo et al. | 148/101 |
| 2003/0183305 | A1 * | 10/2003 | Murakami et al. | 148/302 |
| 2004/0050455 | A1 * | 3/2004 | Kaneko et al. | 148/105 |

FOREIGN PATENT DOCUMENTS

| | | |
|---|---|---|
| JP | 02-247309 | 10/1990 |
| JP | 02-247310 | 10/1990 |
| JP | 2-298003 | 12/1990 |
| JP | 3-261104 | 11/1991 |
| JP | 08-229641 | 9/1996 |
| JP | 11-333549 | 12/1999 |
| JP | 2000-79451 | 3/2000 |
| JP | 2002-100507 | 4/2002 |
| JP | 3297676 B | 7/2002 |
| JP | 2003-178908 A | 6/2003 |
| RU | 2111088 C1 | 5/1998 |
| WO | WO 00/03403 | 1/2000 |

OTHER PUBLICATIONS

G. Ya. Merkulova; "The Temperature Dependence of Coercivity in Nanocrystalline Nd-Fe-B(TiC) Magnets"; Journal of Applied Physics; vol. 87; No. 9; May 2000; pp. 4738-4740.

U.S. Appl. No. 10/381,412 filed on Mar. 25, 2003, currently pending; for: "Process for Producing, Through Strip Casting, Raw Alloy for Nanocomposite Type Permanent Magnet"; Applicants: Ryo Murakami et al.

Official Communication issued in corresponding European Application No. 05024953.1-2122, dated Mar. 10, 2006.

Onodera, et al., "Magnetic Properties of a New Permanent Magnet Based on a Nd-Fe-B Compound"; Journal of Magnetism and Magnetic Material, vol. 46, No. 1-2, Dec. 1984, pp. 151-156.

* cited by examiner

| SAMPLE NO. | No.4 | No.9 |
|---|---|---|
| AVERAGE(μm) | 84.43 | 64.9 |
| MAXIMUM(μm) | 98 | 85 |
| MINIMUM(μm) | 70 | 41 |
| STANDARD DEVIATION(μm) | 6.2582 | 11.166 |

METHOD OF MAKING RAPIDLY SOLIDIFIED ALLOY FOR MAGNET

BACKGROUND OF THE INVENTION

1. Field of the Invention

The present invention generally relates to a method of making a magnet alloy by rapidly cooling and solidifying a molten alloy.

Specifically, the present invention relates to a method of preparing a material alloy for nanocomposite magnets for use in various types of motors, meters, sensors and loudspeakers. More particularly, the present invention relates to a method of making a rapidly solidified alloy for use to produce a nanocomposite magnet in which soft magnetic phases such as iron-based borides and iron and a hard magnetic phase such as an $R_2Fe_{14}B$ compound (where R is a rare-earth element) are magnetically coupled together. It should be noted, however, that the rapidly solidified alloy prepared by the method of the present invention can be used effectively not only in nanocomposite magnets but also in bonded magnets (including rubber magnets) and sintered magnets as well.

The present invention further relates to a magnet powder obtained by pulverizing the rapidly solidified alloy and to a magnet body made of the magnet powder.

2. Description of the Related Art

A nanocomposite magnet, having a structure in which a hard magnetic phase such as $R_2Fe_{14}B$ and soft magnetic phases such as $Fe_3B$ (including $Fe_{3.5}B$) and α-Fe are magnetically coupled together via exchange interactions, is now under development as an R—Fe—B based magnet. A powder of a nanocomposite magnet is compacted into a predetermined shape with a resin binder, thereby forming an isotropic bonded magnet.

In producing a nanocomposite magnet, a rapidly cooled and solidified alloy, having either an amorphous structure or at least a structure consisting mostly of amorphous phases (which will be referred to herein as a "rapidly solidified alloy"), is often used as a starting material thereof. When subjected to a heat treatment, this rapidly solidified alloy crystallizes and eventually becomes a permanent magnet material having a nanocomposite structure with an average crystal grain size of about $10^{-9}$ m to about $10^{-6}$ m.

The structure of the heated and crystallized alloy heavily depends on the structure of the rapidly solidified alloy that is yet to be heated and crystallized. For that reason, to obtain a nanocomposite magnet having excellent magnetic properties, it is important how to define the conditions of rapidly cooling and solidifying a molten alloy because those conditions should determine the specific structure (e.g., the percentage of amorphous phases) of the resultant rapidly solidified alloy.

A rapid cooling process to be performed with a machine such as that shown in FIG. 1 (i.e., a melt spinning machine) is known as a conventional method of preparing such a rapidly solidified alloy including a greater volume percentage of amorphous phases. In this process, a molten alloy is ejected out of a nozzle, having an orifice with an inside diameter of about 1 mm or less at the bottom, toward a rotating chill roller, and rapidly cooled and solidified by the roller, thereby obtaining a thin-strip amorphized solidified alloy.

Methods of this type have been researched and reported by universities and organizations that are engaged in the study of magnetic materials. However, a machine for use in those research studies or reports is modeled just for experimental purposes so as to melt several grams to several hundreds of grams of alloy inside of a nozzle and eject it out of the nozzle. That is to say, a machine having such a low processing rate cannot mass-produce a material alloy for a nanocomposite magnet.

Although not designed specially to make a magnet alloy, a machine including multiple nozzles to eject a molten alloy toward a chill roller is described in Japanese Laid-Open Publications No. 2-179803, No. 2-247304, No. 2-247305, No. 2-247306, No. 2-247307, No. 2-247308, No. 2-247309 and No. 2-247310, for example.

In these methods, a molten alloy, which has been melted in a melting crucible, is teemed into a container having ejecting nozzles at the bottom, and then ejected out of the nozzles toward the surface of a rotating roller by applying a predetermined pressure onto the melt in the container (this method will be referred to herein as a "melt spinning process"). By ejecting the melt through the nozzles while applying a pressure thereto in this manner, a stream of the melt (or a melt flow) having a relatively high flow rate can be ejected substantially perpendicularly toward around the top of the rotating roller. The ejected melt forms a puddle (i.e., a melt puddle) on the surface of the chill roller that is rotating at a relatively high velocity (e.g., at a roller surface velocity of about 20 m/s or more). A portion of this puddle, which is in contact with the roller, is rapidly cooled and solidified, thereby forming a thin-strip rapidly solidified alloy.

In the melt spinning process described above, the molten alloy and the rotating roller have just a short contact length. Accordingly, the melt cannot be rapidly cooled and solidified fully on the rotating roller, and the alloy at a high temperature (e.g., about 700° C. to about 900° C.) is cooled and solidified efficiently enough due to its small thickness (typically about 40 μm or less) even after having left the rotating roller and while traveling in the air. In the melt spinning process, the cooling process is carried out in this manner, thereby amorphizing any of various types of alloys.

The applicant of the present application also disclosed a method of producing a nanocomposite magnet by a strip casting process in Japanese Patent No. 3297676 and PCT International Publication WO 02/30595 A1. Furthermore, known strip casting machines and processes using a tundish are disclosed in Japanese Laid-Open Publications No. 11-333549 and No. 2000-79451, for example.

In the melt spinning process, however, the molten alloy is ejected through the nozzle with a small inside diameter, and receives a strong resistance from the nozzle. Thus, it is necessary to apply a sufficiently high pressure to the molten alloy constantly. Such a high pressure is normally applied by adjusting the weight (and the back pressure if necessary) of the melt itself. Accordingly, a rather heavy melt is always reserved to substantially the same level above the nozzle.

Furthermore, the melt is ejected through the nozzle with such a small inside diameter. Accordingly, once a portion of the nozzle has been clogged up with the melt, the melt starts to receive an even higher resistance from the nozzle, thus possibly varying the ejecting rate of the melt.

As a result, in the conventional melt spinning process, if one tries to raise the productivity of the rapidly solidified alloy by increasing the melt feeding rate to about 1.5 kg/min or more, for example, then it becomes hard to control the melt feeding rate at a constant value. Consequently, the rapid cooling rate likely varies considerably which affects the resultant magnetic properties significantly.

Also, in the melt spinning process, a rapidly solidified alloy including a greater volume percentage of amorphous phases is obtained by ejecting a small amount of melt onto a chill roller that rotates at a relatively high velocity (e.g., at a peripheral velocity of about 20 m/s or more). Thus, the resultant thin-strip rapidly solidified alloy typically has a thickness of about 40 μm or less. It is difficult to collect a thin-strip alloy having such a small thickness so as to efficiently increase the tap density thereof by a sufficient amount. Furthermore, powder particles, obtained by pulverizing such a rapidly solidified alloy with a thickness of about 40 μm or less, have a flat shape. Accordingly, those powder particles exhibit a poor flowability or loadability and result in a low magnet powder fill density in a compaction process, thus often decreasing the magnet powder percentage in the resultant bonded magnet.

On the other hand, a strip casting process is also known as another method of preparing a rapidly solidified alloy as described above. In the strip casting process, a molten alloy is supplied from a melting crucible onto a shoot (or tundish) and then brought into contact with a chill roller, thereby making a rapidly solidified alloy.

Hereinafter, the strip caster and strip casting method as disclosed in Japanese Patent No. 3297676 and PCT International Publication WO 02/30595 A1 will be described with reference to FIG. 2.

As shown in FIG. 2, the strip caster includes a melting crucible 11, a shoot (i.e., a guide member) 14, and a chill roller 13. The melting crucible 11 is provided to melt a material alloy and store the molten alloy therein. The shoot 14 receives the molten alloy 12 that has been teemed from the melting crucible 11 and guides the molten alloy 12 to a predetermined location. Then, the molten alloy 12 is teemed from the end of the shoot 14 onto the chill roller 13 and rapidly cooled and solidified by the chill roller 13.

The shoot 14 includes a melt guide surface, which defines a tilt angle β with respect to a horizontal plane, and controls the flow velocity of the melt running down on the guide surface and rectifies the melt flow, thereby feeding the melt onto the chill roller 13 constantly and continuously.

The molten alloy 12, which has come into contact with the outer circumference of the chill roller 13, moves along the circumference of the roller 13 so as to be dragged by the rotating chill roller 13 and cooled in the meantime. Then, the resultant thin-strip rapidly solidified alloy 15 leaves the chill roller 13. In the strip casting process, the angle α, which is defined by a line that connects a point of contact between the molten alloy 12 and the chill roller 13 (i.e., the location of the melt puddle) to the axis of rotation of the chill roller 13 with respect to a vertical plane, is an important parameter. Suppose the angle α is defined to be positive in the direction opposite to the rotational direction of the chill roller 13. In that case, the greater the angle α, the longer the length of contact portion between the molten alloy 12 and the chill roller 13. In a melt spinning process, the chill roller 13 normally has a relatively high rotational peripheral velocity. Accordingly, unless this angle α is defined substantially equal to zero degrees, the molten alloy 12 is easily splashed off by the rotating chill roller 13. For that reason, in a melt spinning process, the angle α is normally approximately zero degrees and the contact portion between the melt and the chill roller is usually relatively short. In contrast, in the strip casting process, the angle α may be relatively large, the contact portion between the molten alloy and the outer circumference of the roller may be relatively long as measured in the roller circumferential direction, and the molten alloy can be cooled almost completely while on the roller.

As described above, the conventional strip casting process uses no ejecting nozzle unlike the melt spinning process but feeds the molten alloy 12 continuously onto the rotating roller 13 by way of the shoot 14. Thus, the strip casting process is effective for mass production and can reduce the manufacturing cost.

In such a strip casting process, however, the molten alloy being fed from the guide member onto the chill roller has a small kinetic momentum. Accordingly, if the chill roller is rotated at a relatively high velocity, then the degree of contact between the molten alloy and the surface of the chill roller will be too low to form the melt puddle constantly on the surface of the chill roller and to obtain a thin-strip rapidly solidified alloy with a uniform thickness. Thus, even if one tries to make a rapidly solidified alloy having a nanocrystalline structure for a nanocomposite magnet by using the conventional strip caster, the resultant thin-strip rapidly solidified alloy will have non-uniform thicknesses and structure. Consequently, it has been difficult to produce an actually usable rapidly solidified alloy constantly by the conventional strip casting process.

On the other hand, when a strip caster including a tundish as disclosed in Japanese Laid-Open Publications No. 11-333549 and No. 2000-79451 is used, the melt flowing on the tundish has a low flow velocity, and the resultant rapid cooling rate tends to be low. Thus, such a machine has been regarded as ineffective for making a rapidly solidified alloy for a nanocomposite magnet. The reason is as follows. Specifically, if the rapid cooling rate is low, an alloy including a lot of crystal structures with a relatively large grain size is formed easily. Also, the crystal grains of soft magnetic phases such as an α-Fe phase likely have such excessive grain sizes so as to significantly deteriorate the magnetic properties in many cases.

For that reason, the strip caster as disclosed in Japanese Laid-Open Publications No. 11-333549 and No. 2000-79451 is often used to make completely crystallized ingots of a metal. A rapidly solidified alloy obtained in this manner is normally used as a material alloy for a sintered magnet including an $R_2Fe_{14}B$ phase as its main phase, and cannot be used as a material alloy for a nanocomposite magnet in which hard and soft magnetic phases of very small sizes are distributed uniformly in the same metal structure.

SUMMARY OF THE INVENTION

In order to overcome the problems described above, preferred embodiments of the present invention provide a method and apparatus for making a rapidly solidified alloy, exhibiting excellent magnetic properties, for a nanocomposite magnet constantly and at a mass producible level, and also provide a method and apparatus for making a rapidly solidified alloy with excellent magnetic properties for other types of magnets.

A method of making a rapidly solidified alloy for a nanocomposite magnet according to a preferred embodiment of the present invention preferably includes the step of preparing a melt of an alloy having a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element; and M is at least one metal element selected from the group consisting of Al, Si, Ti, V, Cr, Mn, Cu, Zn, Ga, Zr, Nb, Mo, Ag, Hf, Ta, W, Pt, Au and Pb. The mole fractions x, y, z and m preferably satisfy the inequalities of: 10 at %≦x≦35 at %; 2 at %≦y≦10 at %; 0 at %≦z≦10 at %; and 0≦m≦0.5, respectively. The method preferably further includes the step of forming the rapidly solidified alloy by bringing the melt into contact with the surface of a rotating chill roller. In this method, the step of forming the rapidly solidified alloy preferably includes the step of teeming the melt onto a guide member, of which the guide surface defines a tilt angle with respect to a horizontal plane, and then feeding the melt, running down on the guide surface, through at least one tubular hole onto a contact area on the surface of the chill roller.

In one preferred embodiment of the present invention, the step of forming the rapidly solidified alloy preferably includes the step of arranging the guide member such that the guide surface thereof defines a tilt angle of about 5 degrees to about 70 degrees with respect to the horizontal plane.

In another preferred embodiment, the step of forming the rapidly solidified alloy preferably includes the step of arranging the guide member such that an angle $\alpha$ of about 0 degrees to about 80 degrees is defined in a direction opposite to a rotating direction of the chill roller between a vertical plane and a line that connects together a point on the surface of the chill roller, at which the melt contacts with the chill roller for the first time, and the axis of rotation of the chill roller.

In still another preferred embodiment, the step of forming the rapidly solidified alloy preferably includes the step of splitting the melt into a number of melt flows by way of a plurality of tubular holes and then bringing the melt flows into contact with the chill roller.

In yet another preferred embodiment, the step of forming the rapidly solidified alloy preferably includes the step of providing the guide member of which the tubular hole(s) has an opening area of about 0.02 $cm^2$ to about 0.5 $cm^2$.

In yet another preferred embodiment, the step of forming the rapidly solidified alloy preferably includes the step of providing the guide member of which the tubular hole(s) has a length of about 0.5 mm to about 50 mm.

In yet another preferred embodiment, the step of forming the rapidly solidified alloy preferably includes the step of arranging the guide member such that a distance of about 0.3 mm to about 50 mm is provided between the end of the tubular hole(s) and the surface of the chill roller.

In yet another preferred embodiment, the step of forming the rapidly solidified alloy preferably includes the step of arranging the guide member such that an angle $\gamma$ of about −20 degrees to about 40 degrees is defined between a flowing direction of the melt that has just been emitted from the tubular hole and a line that connects together the center of an inlet opening of the tubular hole and the axis of rotation of the chill roller. In this case, the angle $\gamma$ is preferably positive if the melt flowing direction is opposite to the rotating direction of the chill roller and is preferably negative if the melt flowing direction is identical to the rotating direction of the chill roller.

In yet another preferred embodiment, the step of forming the rapidly solidified alloy preferably includes the step of providing the guide member having a structure that supports a member including the tubular hole in an attachable and removable state.

In yet another preferred embodiment, the step of forming the rapidly solidified alloy preferably includes the step of obtaining a rapidly solidified alloy, having an average thickness of more than about 50 μm to about 150 μm with a standard deviation of at most about 10 μm, by teeming the melt onto the guide surface at a rate of at least about 1.5 kg/min and then allowing the melt to run down on the guide surface with the upper surface of the melt exposed to an atmosphere.

In this particular preferred embodiment, the step of forming the rapidly solidified alloy preferably includes the step of bringing the melt into contact with the surface of the chill roller within a reduced pressure atmospheric gas.

More specifically, the step of bringing the melt into contact with the chill roller preferably includes the step of controlling the pressure of the atmospheric gas at about 0.13 kPa to about 100 kPa.

A method of making a nanocomposite magnet powder according to another preferred embodiment of the present invention preferably includes the steps of preparing the rapidly solidified alloy for a nanocomposite magnet by the method according to any of the preferred embodiments of the present invention described above, and pulverizing the rapidly solidified alloy.

In one preferred embodiment, the method preferably further includes the step of conducting a heat treatment process for crystallization purposes before and/or after the step of pulverizing the rapidly solidified alloy is performed.

A method for producing a nanocomposite magnet according to still another preferred embodiment of the present invention preferably includes the steps of preparing a nanocomposite magnet powder by the method according to any of the preferred embodiments of the present invention described above, and compacting the nanocomposite magnet powder into a magnet shape.

A shoot assembly according to yet another preferred embodiment of the present invention preferably receives a melt of an alloy and feeds the melt onto a chill roller of a melt quenching machine. The shoot assembly preferably includes a guide surface, which is made of a material having a melting point that is higher than the temperature of the melt and which defines a tilt angle with respect to a horizontal plane. The shoot assembly preferably further includes a teeming member having at least one tubular hole, which passes the melt that is running down on the guide surface. The teeming member is preferably attachable to, and removable from, the shoot assembly.

A teeming member according to yet another preferred embodiment of the present invention is preferably secured, in a removable state, to the shoot assembly according to a preferred embodiment of the present invention and preferably has at least one tubular hole that passes the melt running down on the guide surface of the shoot assembly.

A melt quenching machine according to yet another preferred embodiment of the present invention preferably includes a chill roller and a shoot assembly, which receives a melt of an alloy and feeds the melt onto the chill roller. The shoot assembly preferably includes a guide surface, which is made of a material having a melting point that is higher than the temperature of the melt and which defines a tilt angle with respect to a horizontal plane, and a teeming member having at least one tubular hole, which passes the melt that is running down on the guide surface. A distance of about 1 mm to about 50 mm is preferably provided between the end of the tubular hole and the surface of the chill roller.

In one preferred embodiment of the present invention, the teeming member is preferably attachable to, and removable from, the shoot assembly.

A method of making a rapidly solidified alloy for a permanent magnet according to yet another preferred embodiment of the present invention preferably includes the steps of preparing a melt of an alloy, and forming the rapidly solidified alloy by bringing the melt into contact with the surface of a rotating chill roller. The step of forming the rapidly solidified alloy preferably includes the step of teeming the melt onto a guide member, of which the guide surface defines a tilt angle with respect to a horizontal plane, and then feeding the melt, running down on the guide surface, through at least one tubular hole onto a contact area on the surface of the chill roller. The step of forming the rapidly solidified alloy preferably includes the step of arranging the guide member such that a distance of about 1 mm to about 50 mm is provided between the end of the at least one tubular hole and the surface of the chill roller.

In one preferred embodiment, the step of forming the rapidly solidified alloy preferably includes the step of arranging the guide member such that the guide surface thereof defines a tilt angle of about 5 degrees to about 70 degrees with respect to the horizontal plane.

In another preferred embodiment, the step of forming the rapidly solidified alloy preferably includes the step of arranging the guide member such that an angle $\alpha$ of about 5 degrees to about 80 degrees is defined in a direction opposite to a rotating direction of the chill roller between a vertical plane and a line that connects together a point on the surface of the chill roller, at which the melt contacts with the chill roller for the first time, and the axis of rotation of the chill roller.

In still another preferred embodiment, the step of forming the rapidly solidified alloy preferably includes the step of splitting the melt into a number of melt flows by way of a plurality of tubular holes and then bringing the melt flows into contact with the chill roller.

In yet another preferred embodiment, the step of forming the rapidly solidified alloy preferably includes the step of providing the guide member of which the tubular hole(s) has an opening area of about 0.03 $cm^2$ to about 0.6 $cm^2$.

In yet another preferred embodiment, the step of forming the rapidly solidified alloy preferably includes the step of providing the guide member of which the tubular hole(s) has a length of about 5 mm to about 50 mm.

In yet another preferred embodiment, the step of forming the rapidly solidified alloy preferably includes the step of rapidly cooling and solidifying the surface of the melt flow that has gone out of the tubular hole, thereby making a tubular member from the melt flow and extending an effective length of the tubular hole to about 10 mm or more.

In yet another preferred embodiment, the step of forming the rapidly solidified alloy preferably includes the step of allowing the melt to run down on the guide surface with the upper surface of the melt being exposed to an atmosphere and filling the tubular hole with the melt flow.

In this particular preferred embodiment, the step of forming the rapidly solidified alloy preferably includes the step of obtaining a rapidly solidified alloy, having an average thickness of more than about 50 μm to about 150 μm with a standard deviation of at most about 10 μm, by teeming the melt onto the guide surface at a rate of at least about 1.5 kg/min.

In yet another preferred embodiment, the step of forming the rapidly solidified alloy preferably includes the step of bringing the melt into contact with the surface of the chill roller within a reduced pressure atmospheric gas while substantially equalizing the pressure of the atmospheric gas on the surface of the melt running down on the guide surface with that of the atmospheric gas on the surface of the melt that has gone out of the tubular hole.

A method of making a magnet powder according to yet another preferred embodiment of the present invention preferably includes the steps of preparing the rapidly solidified alloy for a magnet by the method according to any of the preferred embodiments of the present invention described above, and pulverizing the rapidly solidified alloy.

In one preferred embodiment of the present invention, the method preferably further includes the step of conducting a heat treatment process for crystallization purposes before and/or after the step of pulverizing the rapidly solidified alloy is performed.

A method for producing a magnet according to yet another preferred embodiment of the present invention preferably includes the steps of preparing a magnet powder by the method according to the preferred embodiment of the present invention described above, and compacting the magnet powder to obtain a bonded magnet.

A method for producing a magnet according to yet another preferred embodiment of the present invention preferably includes the steps of preparing a magnet powder by the method according to the preferred embodiment of the present invention described above, and sintering the magnet powder to obtain a sintered magnet.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
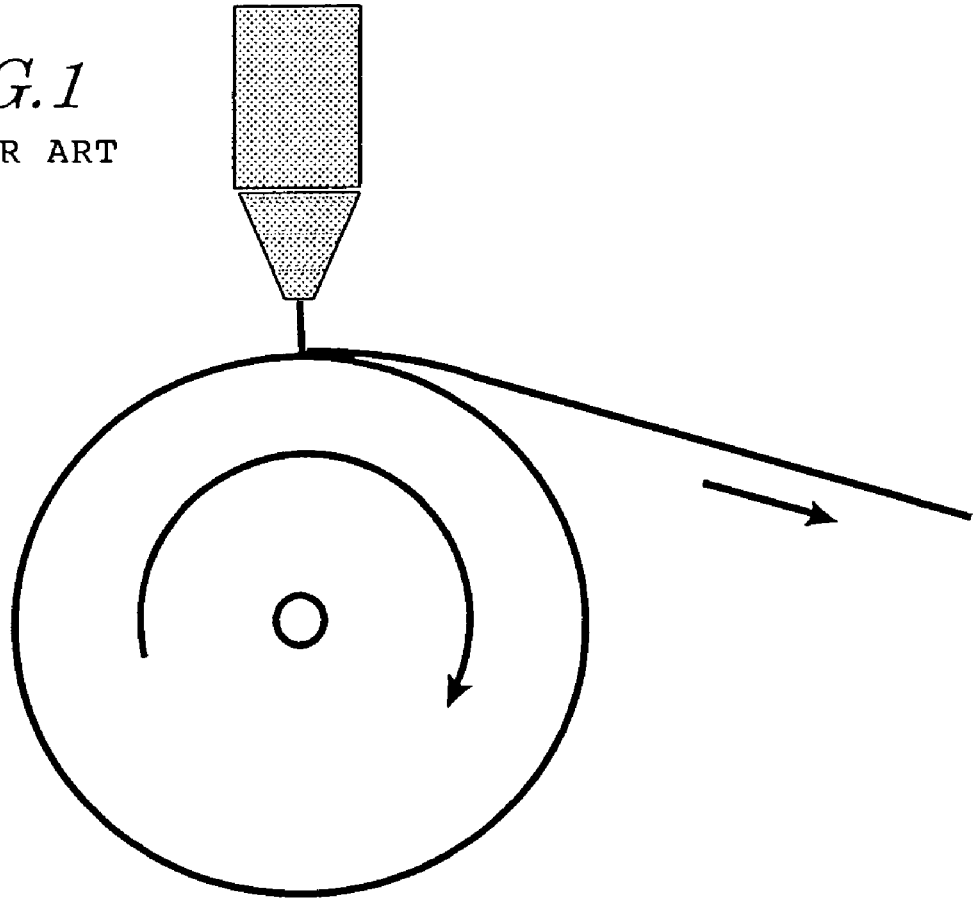
FIG. 1 PRIOR ART
FIG. 1 is a schematic side view illustrating an arrangement for a conventional melt spinning machine.

Hereinafter, preferred embodiments of a method for making a rapidly solidified alloy for a nanocomposite magnet according to the present invention will be described.

A rapidly solidified alloy for a nanocomposite magnet to be obtained by a method according to a preferred embodiment of the present invention preferably has a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element; and M is at least one metal element selected from the group consisting of Al, Si, Ti, V, Cr, Mn, Cu, Zn, Ga, Zr, Nb, Mo, Ag, Hf, Ta, W, Pt, Au and Pb. The mole fractions x, y, z and m preferably satisfy the inequalities of: 10 at %$\leqq x \leqq$35 at %; 2 at %$\leqq y \leqq$10 at %; 0 at %$\leqq z \leqq$10 at %; and $0 \leqq m \leqq 0.5$, respectively.

In a preferred embodiment of the present invention, a melt of the alloy having the composition described above is brought into contact with, and rapidly cooled and solidified by, the surface of a rotating chill roller. In this rapid cooling process step, a guide member, of which the guide surface defines a tilt angle with respect to a horizontal plane, is used, and the melt is teemed onto the guide member. Then, the melt, running down on the guide surface, is fed onto the chill roller by way of at least one tubular hole.

In such a preferred embodiment, the melt, which has been teemed onto the tilted guide surface of the guide member, is rectified appropriately while running down on the guide surface. Then, the rectified melt increases its flow velocity due to a throttling effect while passing through the tubular hole. However, the melt is further rectified while passing through the tubular hole, and then reaches the surface of the chill roller. The melt, which has been emitted from the tubular hole, collides against the surface of the chill roller with a greater kinetic momentum than the kinetic momentum of the melt running down on the guide surface. Accordingly, the degree of contact between the melt and the roller surface increases, thus realizing uniform cooling.

In this manner, according to this preferred embodiment of the present invention, the melt can collide against the chill roller at a melt ejecting rate which is almost comparable to that of the conventional melt spinning machine. Thus, even if the chill roller is rotating at a relatively high peripheral velocity, a rather big melt puddle can be formed on the chill roller constantly. As a result, a thin-strip rapidly solidified alloy with a uniform thickness can be obtained at a constant cooling rate.

It should be noted that the properties of a nanocomposite magnet to be obtained by thermally treating the rapidly solidified alloy are very sensitive to the microstructure of the rapidly solidified alloy yet to be heated. Accordingly, if the rapid cooling conditions change, then the rapidly solidified alloy may have a non-uniform structure, and the resultant magnetic properties may be affected. More specifically, even if the peripheral velocity of the rotating chill roller and the melt feeding rate are kept constant, a portion of the rapidly solidified alloy may still have been cooled at an abnormally low rate. Then, the $\alpha$-Fe phase with an excessively large grain size may be nucleated in that portion, thus possibly deteriorating the resultant magnetic properties.

Also, the average thickness of the thin-strip rapidly solidified alloy does affect the shape of powder particles to be obtained by pulverizing the thin-strip rapidly solidified alloy. Specifically, the thinner the rapidly solidified alloy, the flatter the powder particles. Then, such powder particles will have decreased flowability and loadability, and the resultant green density should decrease, too. On the other hand, if the rapidly solidified alloy prepared is relatively thick, then the powder particles will have an isometric shape and exhibit an increased flowability or loadability. Thus, such a powder is easier to compact into any desired shape. However, the present inventors discovered and confirmed via experiments that when prepared by the conventional melt spinning or strip casting process, such a thick rapidly solidified alloy will have even more non-uniform thicknesses. Accordingly, if a thin-strip rapidly solidified alloy with a thickness exceeding about 50 μm is obtained for the purpose of increasing the flowability of the resultant powder, then a portion of the thin-strip rapidly solidified alloy will include crystal grains with an excessively large grain size, thus weakening the exchange interactions and deteriorating the magnetic properties.

As opposed to the conventional nanocomposite magnet having such properties, a rapidly solidified magnet, having a single phase $R_2Fe_{14}B$ structure, does not have its properties seriously affected by the variation in thickness of the rapidly solidified alloy. Particularly when a thin rapidly solidified alloy with a thickness of about 50 μm or less is prepared as a substantially completely amorphized alloy by increasing the cooling rate of the molten alloy, the final magnet properties are hardly affected by any variation in thickness of the rapidly solidified alloy.

The present inventors discovered and confirmed via experiments that when a molten alloy, having a composition according to a preferred embodiment of the present invention, was ejected and rapidly cooled and solidified by using the conventional melt spinning machine, the melt feeding rate per unit time was not constant and was variable, and the cooling rate achieved changed significantly depending on the location of the thin-strip rapidly solidified alloy obtained. Thus, such a rapidly solidified alloy had a non-uniform structure. In that case, the magnet powder, obtained by pulverizing such an alloy, also exhibited non-uniform magnetic properties. And a magnet, made of such a magnet powder, included powder particles with inferior magnetic properties. Consequently, the overall properties of the resultant magnet were decreased by those inferior powder particles.

Thus, if the conventional melt spinning machine is used to prepare a rapidly solidified alloy having the composition of various preferred embodiments of the present invention, then a high pressure is preferably constantly applied to a melt that is going to pass through a very narrow nozzle orifice. In that case, however, it is difficult to accurately control the pressure to be applied. In addition, the melt is likely subjected to strong resistance from the inner wall of the narrow nozzle orifice, thus varying the melt ejecting velocity or rate significantly.

In contrast, according to a preferred embodiment of the present invention, the melt can be rectified on the tilted melt guide surface, and then can be fed onto the chill roller through a tubular hole having a relatively large opening area at the bottom. Accordingly, although receiving no back pressure (i.e., in a situation where only the gravitational force keeps the melt running), the melt can be fed onto the surface of the roller with a greater kinetic momentum as compared with the conventional strip casting process. As a result, the degree of contact between the melt and the roller surface increases and the gas is much less likely to be absorbed into the gap between the roller surface and the melt, thus cooling the melt more uniformly. In addition, since the kinetic momentum of the melt is almost constant and not variable, the rapidly solidified alloy obtained can have a uniform thickness and a homogeneous structure. Consequently, the resultant magnet can also exhibit improved properties.

Hereinafter, preferred embodiments of the present invention will be described with reference to the accompanying drawings.

Figure 3:
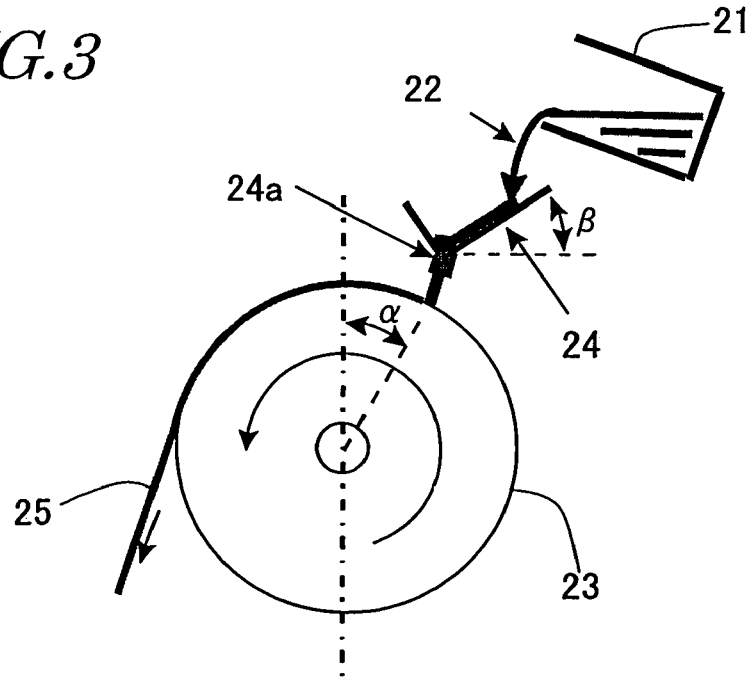
FIG. 3 is a schematic cross-sectional view illustrating an arrangement for a melt quenching machine for use in various preferred embodiments of the present invention.

In this preferred embodiment, a melt quenching machine such as that shown in FIG. 3 is preferably used. The melt quenching machine shown in FIG. 3 is preferably provided in a space (e.g., a chamber) in which either a vacuum or a reduced-pressure inert atmosphere can be created.

As shown in FIG. 3, the melt quenching machine preferably includes a melting crucible 21 for melting a material alloy therein, a chill roller 23 for rapidly cooling and solidifying the molten alloy 22 that has been teemed from the melting crucible 21, and a shoot (or tundish) 24 as a melt guiding member for guiding the molten alloy 22 from the melting crucible 21 onto the chill roller 23. The shoot 24 preferably has a number of tubular holes 24*a* at the end (or bottom) thereof.

The melting crucible 21 can teem the melt 22, prepared by melting the material alloy, onto the shoot 24 at a substantially constant rate. This teeming rate is arbitrarily adjustable by controlling the operation of tilting the melting crucible 21, for example.

The outer periphery of the chill roller 23 is preferably made of a good thermal conductor (e.g., copper). The roller 23 may preferably have an outside diameter of about 20 cm to about 100 cm and a width of about 15 cm to about 100 cm. The roller 23 can be rotated at a predetermined rotational velocity by a motor (not shown). By controlling this rotational velocity, the peripheral velocity of the chill roller 23 is arbitrarily adjustable. In a preferred embodiment, the chill roller 23 is preferably water-cooled inside. The cooling rate achieved by this melt quenching machine is controllable within a range of about $10^{2\circ}$ C./s to about $8\times10^{4\circ}$ C./s by selecting an appropriate rotational velocity for the chill roller 23, for example.

The shoot 24, made of a ceramic, for example, can rectify the flow of the melt 22, which is being continuously teemed from the melting crucible 21 at a predetermined flow rate, by decreasing the flow velocity of the melt 22 to such a degree so as to temporarily reserve the flow of the melt 22. The tilt angle β that is defined by the melt guide surface of the shoot 24 with respect to a horizontal plane is preferably within the range of about 5 degrees to about 70 degrees. The reason is as follows. Specifically, if the tilt angle β is smaller than about 5 degrees, then the melt 22 cannot flow on the guide surface so smoothly so as to make constant the kinetic momentum of the melt 22 being teemed through the tubular hole 24*a*. Thus, no desired uniform rapidly solidified alloy structure can be obtained. However, if the tilt angle β exceeds about 70 degrees, then the melt 22 running down on the guide surface will become a turbulent flow, thus making it impossible to form a melt puddle constantly on the chill roller 23 and instead causing splashing of the melt. The tilt angle β is more preferably about 10 degrees to about 60 degrees, and even more preferably about 15 degrees to about 50 degrees.

As shown in FIG. 3, the angle defined between a vertical plane and a line that connects a point on the surface of the chill roller 23, at which the melt 22 contacts with the chill roller 23 for the first time (which will be referred to herein as a "contact start point"), and the axis of rotation of the chill roller 23 is identified herein by α. When α=0 degrees, the contact start point is located at the top of the roller surface. In the following description, the angle α will be regarded as positive if the contact start point lies upstream to the top of the roller surface in the roller rotating direction but will be regarded as negative if the contact start point lies downstream to the top of the roller surface in the roller rotating direction. If the angle α is negative, no melt puddle can be formed on the chill roller 23 and instead the melt splashes. Thus, the melt cannot be rapidly cooled and solidified as intended. Nevertheless, if the angle α exceeds about 80 degrees, then the melt cannot ride on, and instead drops off, the chill roller 23. Thus, the melt cannot be rapidly cooled and solidified, either. In view of these considerations, α is preferably about 0 degrees to about 80 degrees, more preferably about 2 degrees to about 60 degrees, and even more preferably about 2 degrees to about 45 degrees. By defining the angle α in any of these preferred ranges, the length of the contact region in which the melt keeps contact with the chill roller (which will be referred to herein as a "contact length") can be at least about 10 mm.

Figure 4A:
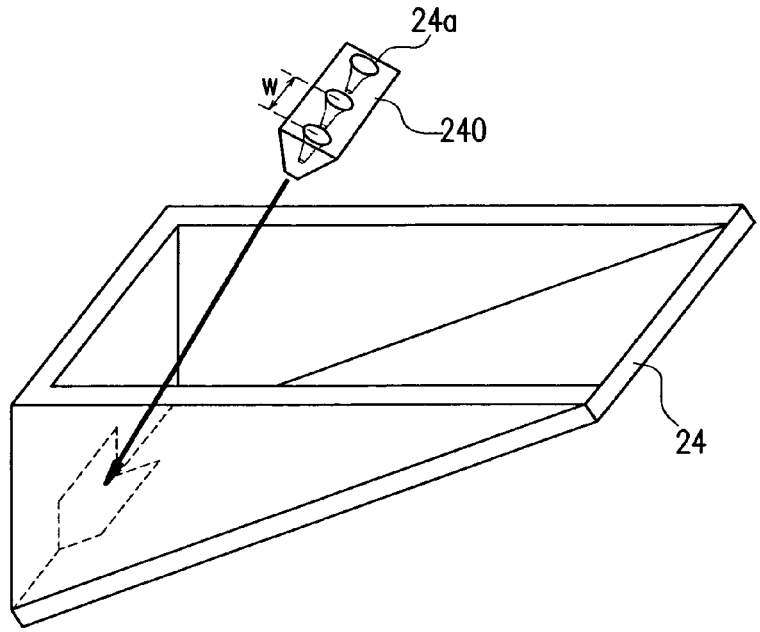
FIGS. 4A and 4B are respectively a perspective view and a cross-sectional view illustrating a shoot which may be used effectively in the machine shown in FIG. 3.

FIG. 4A illustrates a more detailed preferred structure of the shoot 24 for use in this preferred embodiment. As shown in FIG. 4A, the shoot 24 preferably includes a teeming member 240, which is attachable to, and removable from, the end (or bottom) of the shoot 24 that is arranged so as to face the outer periphery of the chill roller 23. In this preferred embodiment, the teeming member 240 preferably includes three tubular holes 24*a*, which are arranged at regular intervals W. As used herein, the interval W is defined as the distance between the centers of two adjacent tubular holes 24*a*. The interval W between the tubular holes 24*a* is preferably about 10 mm to about 50 mm and more preferably about 15 mm to about 40 mm. In this preferred embodiment, the interval W is preferably about 30 mm.

Figure 4B:
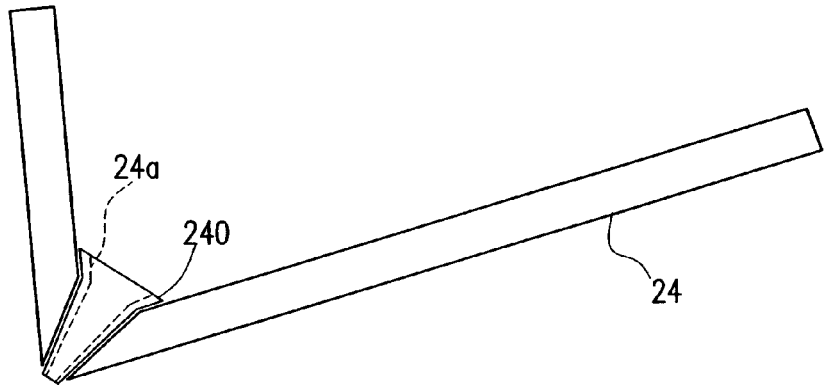

FIG. 4B is a cross-sectional view of the shoot 24 shown in FIG. 4A. As shown in FIG. 4B, the teeming member 240 is supposed to be attached to, and removed from, the shoot 24 from above the guide surface. In this preferred embodiment, the tubular holes 24*a* are provided for such a replaceable shoot 24. Accordingly, even when the tubular holes 24*a* are clogged up with the melt, there is no need to replace the shoot 24 in its entirety but the teeming member 240 has only to be replaced.

Figure 4C:
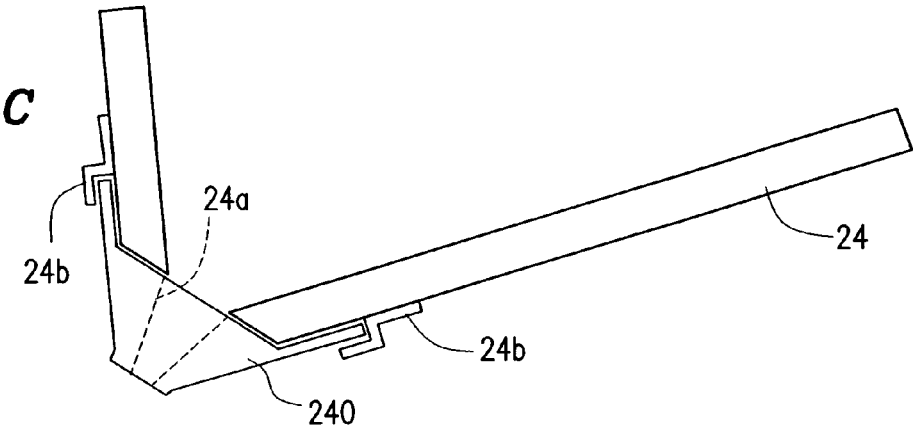
FIG. 4C is a cross-sectional view illustrating an alternative shoot for use in another preferred embodiment of the present invention.

It should be noted that the present invention is in no way limited to a shoot having such a structure. For example, as shown in FIG. 4C, the shoot 24 may include a guide portion 24*b* for use to slide the teeming member 240 thereon. If the shoot 24 shown in FIG. 4C is used, the teeming member 240 is attachable to, and removable from, the shoot 24 in a direction that is substantially perpendicularly to the melt flowing direction (i.e., substantially parallel to the axis of rotation of the chill roller).

The tubular holes 24*a* do not have to be straight but may be curved. Also, the inside diameter of the tubular holes 24*a* does not have to be constant, but may decrease gradually, in the melt flowing direction. In any case, however, the tubular holes 24*a* need to have such a shape that minimizes a turbulent flow.

The tubular holes 24*a* preferably have an appropriate opening area at the bottom thereof. In preparing a rapidly solidified alloy for a nanocomposite magnet having the composition described above, if the opening area of the tubular holes 24*a* exceeds about 0.5 $cm^2$, then the melt 22 is ejected at an excessively high rate, thus making it hard to form a melt puddle constantly on the roller 23 but possibly splashing the melt. In that case, the melt may not be rapidly cooled and solidified as intended. Conversely, if the opening area of the tubular holes 24*a* is less than about 0.02 $cm^2$, then the melt quenching rate per unit time will be short, such as about 1.5 kg/min. In that case, not only will productivity decrease significantly but also the resultant rapidly solidified alloy structure will include at least about 50 vol % of amorphous phases. Then, the magnetic properties of the final permanent magnet product will somewhat deteriorate. In view of these considerations, the tubular holes (i.e., teeming ports) 24*a* preferably have an opening area of about 0.02 $cm^2$ to about 0.5 $cm^2$. The minimum required opening area is more preferably about 0.03 $cm^2$ and even more preferably about 0.05 $cm^2$. Meanwhile, the maximum allowable opening area may be about 0.2 $cm^2$ and may also be about 0.15 $cm^2$.

To further increase the melt quenching rate per unit time, four or more tubular holes 24*a* may be provided. In any case, multiple tubular holes 24*a* are preferably provided. This is because even if each of those tubular holes 24*a* has a relatively small opening area, the overall processing rate can still be kept sufficiently high in that case. Stated otherwise, if just one or two tubular holes 24*a* is provided, each of those tubular holes 24*a* preferably has a relatively large opening area (e.g., at least about 0.07 $cm^2$).

In this preferred embodiment, the melt 22 that has been teemed onto the shoot 24 then contacts with the chill roller 23 by way of the three tubular holes 24*a*. Thus, the resultant three melt flows 22, which have just contacted with the chill roller 23, move on the outer periphery of, and are rapidly cooled and solidified by, the chill roller 23 rotating.

To prevent the melt flow, which has been rectified by running down on the guide surface of the shoot 24, from turning into a turbulent flow, the tubular holes 24*a* preferably have a length of at least about 0.5 mm. However, if the tubular holes 24*a* are too long, then a portion of the melt 22 might be cooled and solidified inside of the tubular holes 24*a*, thus possibly clogging up the tubular holes 24*a* with the melt. For that reason, the tubular holes 24*a* preferably have a length of at most about 50 mm.

Also, the distance between the bottom of the tubular holes 24*a* and the surface of the chill roller 23 is preferably about 1 mm to about 50 mm. It should be noted, however, that after the melt 22 has been emitted from the tubular holes 24*a* and before the melt 22 reaches the chill roller 23, the surface portion of the melt 22 has some of its heat dissipated into the cooling atmosphere and may be solidified partially. In that case, the solidified surface portion of the melt will function as a sort of a cylindrical member with a tubular hole (which will be referred to herein as a "pseudo-tubular member"), which thinly coats the melt flowing inside. When such a pseudo-tubular member is formed, the effects achieved are as if the tubular holes 24*a* of the shoot 24 had an extended length. For that reason, the distance between the bottom of the tubular holes 24*a* and the surface of the chill roller 23 is preferably about 3 mm or more such that the substantial length of the tubular holes 24*a* falls within a preferred range of about 0.5 mm to about 30 mm.

Such a pseudo-tubular member with a tubular hole is formed by allowing the surface portion of the melt, which has been emitted from the tubular hole 24*a* of the shoot 24, to be cooled and solidified by the atmospheric gas. However, the pseudo-tubular member formed in this manner is always in contact with, and heated to a high temperature by, the melt flow running, and therefore, is not always solidified fully but may be molten at least partially. For that reason, the "solidified" state exhibited by the pseudo-tubular member broadly refers herein to a state of the tubular member with a rigidity that is high enough to control the melt flow being fed onto the chill roller. Thus, even if the tubular member is in the "solidified" state, the tubular member is not necessarily solidified fully.

Such a pseudo-tubular member, formed by the natural solidification of the melt, may be replaced with a teeming member having a tubular hole of a sufficient length (e.g., about 20 mm or more). In that case, however, if the tubular hole is narrow, then the relatively long tubular hole might be clogged up with the melt. Nevertheless, if the rapid cooling process is carried out with the distance between the end of the tubular hole and the surface of the chill roller shortened (i.e., without allowing the pseudo-tubular member, formed by the natural solidification of the melt, to extend its length sufficiently), then a melt puddle may not be formed constantly and easily on the chill roller. This is probably because the effective length of the tubular hole, including that of the additional pseudo-tubular member, would be short of a sufficient length and the melt flow would be disturbed in that case. In view of these considerations, the melt quenching process is preferably started with a distance of at least about 5 mm (more preferably, at least about 10 mm) provided between the end of the original tubular hole and the surface of the chill roller. Then, the effective length of the tubular hole is preferably extended to somewhere between about 7 mm and about 50 mm by extending the pseudo-tubular member after that.

It should be noted that if multiple melt contact zones (or melt quenching zones) are defined on the outer periphery of the chill roller 23 by providing a plurality of tubular holes 24*a* as is done in this preferred embodiment, then each of the resultant melt flows can be quenched under substantially uniform conditions while the melt is being fed onto the chill roller 23 at an increased rate per unit time. Compared with the situation where the melt is fed onto a single zone on the chill roller 23 at a rather high rate, the increase in temperature of the chill roller 23 can be reduced significantly and the cooling ability of the chill roller 23 can be maintained sufficiently high. As a result, even when a rapidly solidified alloy with a thickness of more than about 50 μm is prepared, the variation in the thickness thereof can be minimized. Alternatively, a plurality of shoots, each including at least one tubular hole, may be arranged with respect to a single chill roller such that multiple melt contact zones are defined on the single chill roller.

In addition, the shoot 24 can also adjust the temperature of the melt 22 that is about to reach the chill roller 23. The temperature of the melt 22 on the shoot 24 is preferably higher than the liquidus temperature thereof by about 100° C. or more. This is because if the temperature of the melt 22 is too low, then initial crystals, which will affect the properties of the resultant rapidly solidified alloy, might locally nucleate and remain in the rapidly solidified alloy. The melt temperature on the shoot 24 is controllable by adjusting the temperature of the melt that is being teemed from the melting crucible 21 toward the shoot 24 or the heat capacity of the shoot 24 itself, for example. If necessary, a shoot heater (not shown) may be provided specially for this purpose. To minimize the decrease in the temperature of the melt on the shoot 24, the melt flowing area on the shoot preferably has a relatively short length. In a preferred embodiment, such a length is preferably about 3 cm to about 20 cm.

The molten alloy is solidified on the outer periphery of the chill roller 23 into a thin-strip rapidly solidified alloy 25, which soon leaves the chill roller 23.

Figure 5:
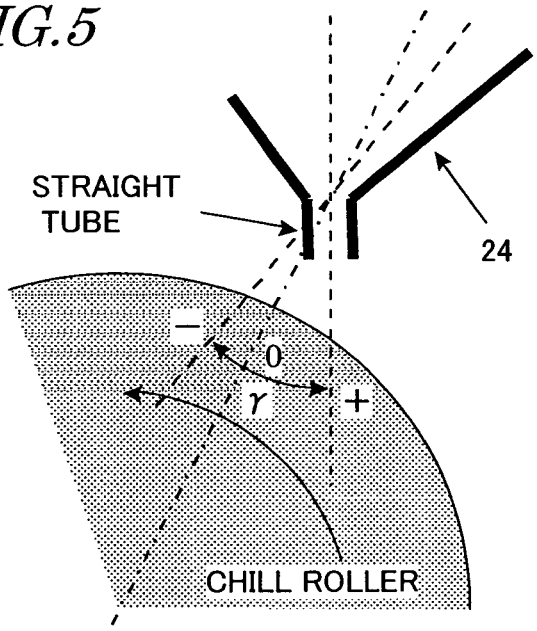
FIG. 5 is a schematic cross-sectional view showing the details of a tubular hole provided for the shoot shown in FIG. 3.

Next, referring to FIG. 5, the angle, defined between the flowing direction of the melt 22 that has just been emitted from the tubular hole 24*a* and a line that connects together the center of the inlet opening of the tubular hole 24*a* and the axis of rotation of the chill roller 23, is identified herein by γ. In the following description, the angle γ is positive if the melt flowing direction is opposite to the rotating direction of the chill roller 23 and is negative if the melt flowing direction is identical to the roller rotating direction. In this preferred embodiment, the angle γ is preferably about −20 degrees to about 40 degrees. The reason is as follows. Specifically, if the angle γ was smaller than about −20 degrees, then no puddle would be formed, but the melt would splash instead and could not be quenched as intended. On the other hand, if the angle γ exceeded about 40 degrees, then the melt could not ride on, but would drop off, the roller, and could not be quenched as intended, either. In view of these considerations, the angle γ is preferably about −15 degrees to about 30 degrees, and more preferably about −13 degrees to about 25 degrees.

The thin-strip rapidly solidified alloy to be prepared preferably has an average thickness of more than about 50 μm to about 150 μm. According to a preferred embodiment of the present invention, the standard deviation of the thickness of the rapidly solidified alloy can be controlled to about 20 μm or less. As a result, the rapidly solidified alloy can have a uniform structure and can have its magnetic properties improved significantly. If a rapidly solidified alloy with an average thickness of less than about 50 μm should be obtained at as high a melt feeding rate as about 1.5 kg/min or more, then the chill roller should be rotated at a rather high peripheral velocity. In that case, a substantially completely amorphized alloy may be obtained. However, as for a nanocomposite magnet to be produced by a preferred embodiment of the present invention, if such a substantially completely amorphized rapidly solidified alloy is thermally treated, then a nanocomposite structure with excellent magnetic properties cannot be formed constantly. The present inventors evaluated the magnetic properties of thermally treated alloys. As a result, the present inventors discovered that the minimum required average thickness of the rapidly solidified alloy is more preferably about 55 μm and even more preferably about 60 μm.

On the other hand, if the peripheral velocity of the chill roller 23 is controlled such that the thin-strip rapidly solidified alloy will have an average thickness of more than about 150 μm, then the molten alloy may be quenched by the chill roller 23 insufficiently. In that case, iron-based borides to be precipitated in the resultant rapidly solidified alloy may have an average crystal grain size of more than about 50 nm and an α-Fe phase with an excessive grain size of about 100 nm or more may be produced. When a magnet is produced by thermally treating a rapidly solidified alloy with such a crystalline structure, the magnet should exhibit decreased loop squareness at the demagnetization curve thereof. For that reason, the rapidly solidified alloy preferably has an average thickness of at most about 150 μm.

Generally speaking, the thicker the thin-strip rapidly solidified alloy, the lower the cooling rate and the greater the sizes of crystals precipitated in the rapidly solidified alloy. In an alloy to be a nanocomposite magnet according to this preferred embodiment, if the soft magnetic phases included in the rapidly solidified alloy, such as α-Fe and iron-based borides, have an average crystal grain size of more than about 50 nm, then a magnetic domain wall will be created inside the crystal grains of the hard magnetic phase. In that case, due to exchange coupling occurring between those soft magnetic phases and the hard magnetic $Nd_2Fe_{14}B$ phase, even a very weak external demagnetizing field easily produces inversion of magnetization, thus possibly deteriorating expected hard magnetic properties. For that reason, the soft magnetic phases included in the rapidly solidified alloy preferably have an average crystal grain size of at most about 50 nm, more preferably at most about 30 nm, and even more preferably at most about 20 nm.

On the other hand, the $Nd_2Fe_{14}B$ phase preferably has an average crystal grain size of at most about 300 nm, which is a single magnetic domain size. To improve the magnetic properties through exchange interactions, the $Nd_2Fe_{14}B$ phase preferably has an average crystal grain size of at most about 200 nm. The maximum allowable average crystal grain size of the $Nd_2Fe_{14}B$ phase is preferably about 150 nm, and even more preferably about 100 nm.

In various preferred embodiments of the present invention, it is important to define the thickness and width of the resultant thin-strip rapidly solidified alloy within their preferred ranges by appropriately determining the inside diameter and the number of tubular holes 24*a*, the melt feeding rate and the peripheral velocity of the chill roller 23, for example. To obtain a uniform structure, it is also necessary to uniformize the cooling rate in the width direction. For that purpose, the thin-strip rapidly solidified alloy preferably has its width controlled to about 3 mm to about 20 mm by adjusting the opening area of the tubular holes 24*a*. The wider the thin-strip rapidly solidified alloy, the easier the alloy can be pulverized. Accordingly, the thin-strip rapidly solidified alloy more preferably has a width of at least about 5 mm.

Furthermore, if the rapid cooling atmosphere had an excessively high pressure, then the inert gas, surrounding the chill roller 23 that is rotating at a high velocity, would be absorbed into the melt being quenched. In that case, the melt could not be quenched constantly. On the other hand, if the atmospheric gas had too low a pressure, then the thin-strip rapidly solidified alloy, which has left the chill roller 23, could not be cooled by the inert gas quickly and might be crystallized excessively. Then, a desired alloy including a lot of amorphous phases could not be obtained. In that case, the thermally treated alloy would exhibit deteriorated magnetic properties. In view of these considerations, the inert gas preferably has a pressure of about 0.13 kPa to about 10 kPa. When the rapid cooling atmosphere has a pressure that is within this preferred range, the pseudo-tubular member can also be formed constantly by the natural solidification of the surface portion of the melt flow.

Preferred Composition for Nanocomposite Magnet

Q is at least one of B (boron) and C (carbon). B is an indispensable element for an iron-based boride such as a soft magnetic $Fe_3B$ or $Fe_{23}B$ phase and the hard magnetic $R_2Fe_{14}B$ phase, which are main phases of a nanocomposite permanent magnet material. If the mole fraction x of B is outside of the 10–30 at % range, then the permanent magnet properties are not achievable. For that reason, the B mole fraction x preferably satisfies 10 at % $\leqq x \leqq$ 30 at %. As used herein, "$Fe_3B$" includes $Fe_{3.5}B$, which is almost indistinguishable from $Fe_3B$.

Furthermore, if the mole fraction x of B is lower than about 10 at %, then the amorphous formability of the melt would decrease significantly. In that case, if a rapidly solidified alloy is prepared by a method according to a preferred embodiment of the present invention, then the molten alloy will not be supercooled during the rapid solidification process, and therefore, a thin-strip alloy with excellent smoothness cannot be obtained. Also, even when such a thin-strip rapidly solidified alloy is heated and crystallized, the desired uniform nanocomposite magnet structure cannot be obtained and excellent magnetic properties are not achievable. On the other hand, if the mole fraction x of B exceeds about 30 at %, then the hard magnetic phase cannot be produced sufficiently. Thus, a preferred x range is about 10 at % to about 20 at %, and a more preferable x range is about 10.5 at % to about 20 at %. It should be noted that C may be substituted for up to about 50 at % of B because the magnetic properties or metal structure would not be affected by the substitution.

The rare-earth element R is an element indispensable for $R_2Fe_{14}B$, which is a hard magnetic phase needed to exhibit permanent magnet properties. In various preferred embodiments of the present invention, R preferably includes at least one element selected from the group consisting of Pr, Nd, Dy and Tb. However, to control the amorphous formability and the crystallization temperature, any other rare-earth element may be substituted for a portion of R. The mole fraction y of R should not be lower than about 2 at % because the hard magnetic phase having the $R_2Fe_{14}B$ crystal structure cannot be produced at an R mole fraction y of less than about 2 at %. However, if the R mole fraction y is more than about 10 at %, then no iron or iron-based borides will be produced and no nanocomposite magnet can be obtained. In view of these considerations, the mole fraction y of R preferably satisfies 2 at %≦y<10 at %. A more preferable y range is about 3 at % to about 9.5 at % and an even more preferable y range is about 4 at % to about 9.2 at %.

The balance of the material alloy, other than the elements described above, may be Fe alone, a portion of which may be replaced with Co, though. Then, the loop squareness of the demagnetization curve will improve and the maximum energy product $(BH)_{max}$ will increase.

Furthermore, a portion of Fe may also be replaced with at least one metal element M that is selected from the group consisting of Al, Si, Ti, V, Cr, Mn, Cu, Zn, Ga, Zr, Nb, Mo, Ni, Hf, Ta, W, Pt, Pb, Au and Ag. However, if the total mole fraction z of the at least one metal element M exceeds about 10 at %, then the magnetization would decrease. Thus, a preferred z range is 0 at %≦z≦10 at % and a more preferred z range is 0.3 at %≦z≦5 at %.

Among these metal elements, Ti brings about particularly beneficial effects. This is because when Ti is added, a compound having the $R_2Fe_{14}B$ crystal structure (i.e., the hard magnetic phase) will nucleate and grow preferentially and the creation of the α-Fe phase will be minimized during the rapid solidification process. Also, a structure in which iron-based borides of a very small size are thinly distributed on the grain boundary of the hard magnetic phase is obtained. Such a structure can exhibit excellent magnetic properties as a nanocomposite magnet. Thus, Ti is preferably added. Ti is preferably added at a mole fraction of about 0.5 at % to about 7 at %, more preferably about 1 at % to about 6 at %.

EXAMPLES

Hereinafter, specific examples of preferred embodiments of the present invention will be described. In the following specific examples of preferred embodiments of the present invention, a melt quenching machine such as that shown in FIG. 3 was used. Specifically, first, the respective materials Nd, Fe, Co, B, C and Ti with purities of about 99.5% or more were weighed such that the mixture had a total weight of about 5 kg and an alloy composition $Nd_{8.5}Fe_{75}CO_2B_{11}C_1Ti_{2.5}$ (where the subscripts indicate atomic percentages). Then, the mixture was injected into a crucible of alumina.

Next, the material alloy was melted by a high frequency heating process in the alumina crucible, thereby obtaining a molten alloy having the composition described above. The molten alloy had a temperature of about 1,350° C. Thereafter, the alumina crucible was tilted to teem the molten alloy onto the guide surface of the shoot assembly shown in FIGS. 4A and 4B.

A replaceable member with one, two, three or four tubular holes was fitted in the bottom of the guide surface. Thus, the melt running down on the guide surface was converged by the tubular hole(s) so as to be fed onto the surface of a chill roller that was rotating under the tubular hole(s).

The tubular hole(s) of the shoot had a length of about 20 mm. The distance between the end of the tubular hole(s) and the surface of the chill roller was also about 20 mm. The melt that had been emitted out of the tubular hole(s) was brought into contact with, and rapidly cooled and solidified by, the chill roller that was provided within an Ar atmosphere having a pressure of about 11.3 kPa. The chill roller was rotating at a peripheral velocity of about 15 m/s. The conditions of this rapid cooling process, including the number and the opening area of tubular holes provided, are shown in the following Table 1:

TABL 1

| | No. of Holes | Opening Area ($cm^2$) | α (deg) | β (deg) | γ (deg) | Rapidly solidified? | Melt Quenching Rate (kg/min) |
|---|---|---|---|---|---|---|---|
| EXAMPLES | | | | | | | |
| 1 | 2 | 0.03 | 10 | 32 | 10 | YES | 4.0 |
| 2 | 2 | 0.07 | 20 | 40 | 3 | YES | 5.3 |
| 3 | 3 | 0.07 | 30 | 35 | 5 | YES | 7.0 |
| 4 | 3 | 0.13 | 30 | 35 | 5 | YES | 11.0 |
| 5 | 1 | 0.18 | 10 | 25 | 0 | YES | 7.3 |
| 6 | 4 | 0.07 | 30 | 25 | 5 | YES | 8.7 |
| 7 | 3 | 0.07 | 10 | 35 | 10 | YES | 7.0 |
| 8 | 2 | 0.13 | 30 | 35 | −12 | YES | 7.2 |
| CMP | | | | | | | |
| 9 | — | — | 30 | 25 | — | YES | 6.0 |
| 10 | — | — | 10 | 25 | — | YES | 6.0 |
| 11 | — | — | 30 | 35 | — | NO | — |

In each of Comparative Examples Nos. 9, 10 and 11, a thin-strip rapidly solidified alloy was prepared by a strip casting process using a guide member with no tubular holes. The material alloy had the same composition as that used for the specific examples of preferred embodiments of the present invention. As shown in Table 1, the thin-strip rapidly solidified alloy could be obtained under the conditions for Samples Nos. 9 and 10, but could not be obtained under the conditions for Sample No. 11. In the comparative examples, the melt collided against the roller surface with a small kinetic momentum and maintained a low degree of contact with the roller surface. Thus, the portion of the resultant thin-strip rapidly solidified alloy, which had been in contact with the roller surface, exhibited a low degree of smoothness and had a great number of tiny concave portions. This means that the rapidly solidified alloy had a number of locally insufficiently cooled portions. Thus, a magnet made of such an alloy should exhibit deteriorated magnetic properties.

Figure 6:
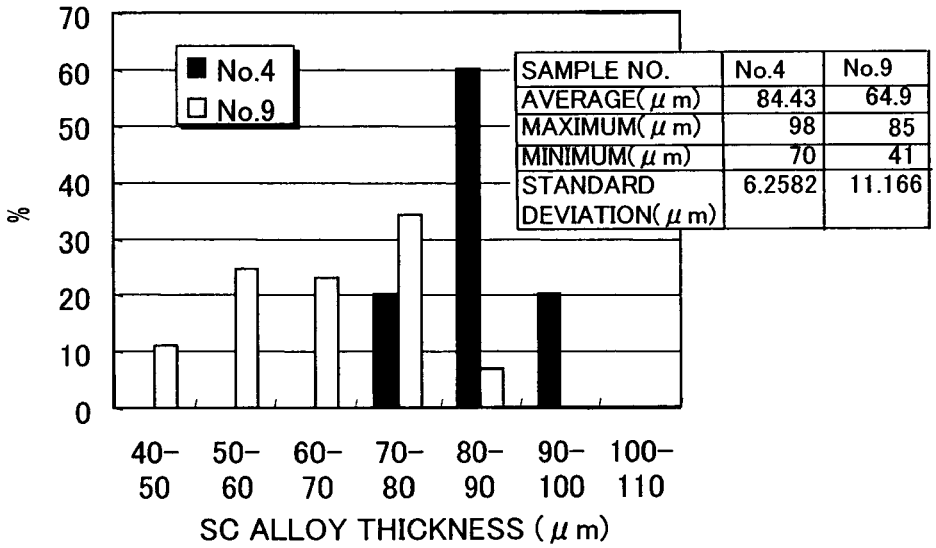
FIG. 6 is a graph showing the thickness distributions of thin-strip rapidly solidified alloys for a specific example of a preferred embodiment of the present invention and a comparative example.

FIG. 6 shows the thickness distribution of thin-strip rapidly solidified alloys, which were obtained as a specific example of preferred embodiments of the present invention under the conditions for Sample No. 4 shown in Table 1, and the thickness distribution of thin-strip rapidly solidified alloys, which were obtained as a comparative example under the conditions for Sample No. 9 shown in Table 1. The thicknesses of 100 pieces of the thin-strip rapidly solidified alloys were measured with a micro gauge having spherical surfaces. Each of those pieces had a length of about 20 mm to about 50 mm and a width of about 6 mm.

As can be seen from the results shown in FIG. 6, the thin-strip rapidly solidified alloys representing the specific examples of preferred embodiments of the present invention had more uniform thicknesses than the thin-strip rapidly solidified alloys representing the comparative example. Sample No. 4 was obtained at a higher melt feeding rate than Sample No. 9. Thus, the average thickness of the resultant thin-strip rapidly solidified alloys of Sample No. 4 was greater than that of Sample No. 9. In the comparative example, the thicknesses of the thin-strip rapidly solidified alloys were distributed over a much broader range than the specific examples of preferred embodiments of the present invention. This is probably because the degree of contact between the melt and the roller surface should be low in the comparative example.

The thin-strip rapidly solidified alloys representing the comparative example had a smaller average thickness than the thin-strip rapidly solidified alloys representing the specific examples of preferred embodiments of the present invention. However, even if the melt feeding rate was increased to obtain thin strips having an average thickness comparable to that of the thin-strip rapidly solidified alloys representing Sample No. 4 by using a strip caster for the comparative example, the melt puddle could not be formed constantly and thin-strip alloys with the required thickness could not be obtained with good reproducibility.

As is clear from these results, according to specific examples of preferred embodiments of the present invention, although the average thickness thereof was about 80 μm or more, thin strip rapidly solidified alloys could be obtained with good reproducibility and with the standard deviation of the thickness minimized.

Next, the thin-strip rapidly solidified alloys, obtained under the conditions specified above, were coarsely pulverized by a power mill to a size of about 850 μm or less. Then, the coarsely pulverized alloys were subjected to a heat treatment. Specifically, the alloys were heated to, and maintained for about 10 minutes at, about 700° C. within an Ar atmosphere by using a hoop belt continuous heating furnace, and then were cooled to room temperature. As a result of this heat treatment, amorphous phases, which had been present in the rapidly solidified alloys, were crystallized, and a final nanocomposite magnet structure was obtained. The magnetic properties of the nanocomposite magnet powders obtained in this manner were measured with a vibrating sample magnetometer. The results are shown in the following Table 2:

TABLE 2

| | $B_r$ (mT) | $(BH)_{max}$ (kJ/m$^3$) | $H_{cJ}$ (kA/m) |
|---|---|---|---|
| | | EXAMPLES | |
| 1 | 900 | 120 | 666 |
| 2 | 863 | 116 | 672 |
| 3 | 870 | 115 | 672 |
| 4 | 862 | 112 | 661 |
| 5 | 853 | 110 | 681 |
| 6 | 866 | 115 | 675 |
| 7 | 882 | 117 | 669 |
| 8 | 873 | 115 | 683 |
| | | CMP | |
| 9 | 834 | 104 | 684 |
| 10 | 843 | 103 | 652 |
| 11 | 827 | 98 | 671 |

The preferred embodiments of the present invention and specific examples thereof described above relate to a nanocomposite magnet. However, the present inventors discovered and confirmed via experiments that the manufacturing process to be carried out with the machine shown in FIG. 3 was effectively applicable for use in not only making a rapidly solidified alloy for a nanocomposite magnet but also making rapidly solidified alloys for other types of magnets including bonded magnets and sintered magnets. That is to say, the present invention is not limited to an alloy with any special composition as long as the alloy is to be melted and rapidly cooled and solidified. In other words, the apparatus and method for making a rapidly solidified alloy according to various preferred embodiments of the present invention is broadly applicable for use to make a rapidly solidified alloy for any type of magnet.

Hereinafter, a method for making a rapidly solidified alloy for a sintered magnet according to an alternative preferred embodiment of the present invention will be described.

Even when the machine shown in FIG. 3 is used to make a rapidly solidified alloy for a sintered magnet, the melt, running down on the guide surface of the tilted shoot, is converged by the tubular hole(s) while passing through the tubular hole(s), and then is ejected with a great kinetic momentum while maintaining a laminar flow state. Thus, the melt also collides against the surface of the chill roller with the great kinetic momentum. As a result, the degree of contact between the molten alloy and the surface of the chill roller increases, and a melt puddle can be formed constantly even on the surface of the rotating chill roller.

In the conventional strip caster, the melt is fed onto the chill roller by way of a tundish, which is provided to retain the melt there temporarily, and the size of a melt puddle formed is defined by the gap between the melt feeding port of the tundish and the surface of the chill roller. Thus, in the conventional process, the gap between the melt feeding port of the tundish and the surface of the chill roller could be no greater than about 0.5 mm. Also, in the prior art, nobody carried out the idea of accelerating the melt flow by tilting the melt guide surface of the tundish, and therefore, the melt was normally fed through the melt feeding port of the tundish onto the surface of the chill roller at a low flow velocity. Consequently, the conventional strip caster could not achieve a sufficient degree of contact between the melt and the roller surface.

As described above, according to various preferred embodiments of the present invention, the degree of contact between the melt and the roller surface is increased significantly, thus minimizing the unwanted absorption of the atmospheric gas into the gap between the melt and the roller surface and further stabilizing the kinematic momentum of the melt. As a result, the thickness and cooling rate of the resultant rapidly solidified alloys can be made uniform. Consequently, compared to the conventional strip casting process, a rapidly solidified alloy structure of a more uniform quality can be obtained. In the prior art, no rapidly solidified alloy for a sintered magnet could be as uniformly organized as the rapidly solidified alloy obtained by a preferred embodiment of the present invention. However, the present inventors discovered that even a material alloy for a sintered magnet preferably has a highly uniform alloy structure to achieve excellent magnetic properties (e.g., high coercivity among other things).

In making a rapidly solidified alloy for a sintered magnet, however, if the outlet of the tubular hole(s) had an opening area exceeding about 0.6 cm$^2$, then the melt feeding rate would be too high to form the melt puddle constantly on the chill roller. In that case, the melt might splash and could not be quenched as intended. However, if the outlet of the tubular hole(s) had an opening area of less than about 0.03 cm$^2$, then the melt processing rate per unit time would be short of about 1.5 kg/min and the productivity would drop significantly.

In view of these considerations, in making a rapidly solidified alloy for a sintered magnet, the outlet of the straight tubular holes preferably has an opening area of about 0.03 cm$^2$ to about 0.6 cm$^2$, more preferably about 0.07 cm$^2$ to about 0.4 cm$^2$.

It should be noted that by providing a number of tubular holes around the end of the shoot, the melt processing rate per unit time can be increased.

As for the specific arrangement (i.e., preferred ranges of the angles α, β and γ) of the shoot in the melt quenching machine, the conditions as already described for the nanocomposite magnet also apply to the rapidly solidified alloy for a sintered magnet.

The apparatus and method according to various preferred embodiments of the present invention described above increases the degree of contact between the molten alloy and the surface of the chill roller significantly and quenches the melt highly uniformly, thus providing a rapidly solidified alloy with an even more uniform structure for any type of magnet. These beneficial effects are achieved irrespective of the specific composition of the material alloy to be processed or whether the magnet to be obtained is a bonded magnet or a sintered magnet.

Also, in the apparatus and method according to various preferred embodiments of the present invention, the distance between the end of the shoot and the surface of the chill roller can be increased, and yet the melt puddle can be formed far more constantly, as compared with the conventional strip caster. Thus, even a relatively thick rapidly solidified alloy can also be formed constantly.

Furthermore, since the distance between the end of the shoot and the surface of the chill roller increases, it is possible to avoid an unexpected halt of the melt quenching process due to clogging of the gap between the end of the shoot and the surface of the chill roller with a solidified portion of the melt around the end of the shoot. Particularly when the teeming member with at least one tubular hole is replaceable as shown in FIGS. 4A through 4C, the melt quenching machine can be operated normally for a long time just by replacing the teeming member 240 only, not the shoot 24 in its entirety.

Furthermore, according to preferred embodiments of the present invention, the melt runs down on the guide surface of the tilted shoot at a relatively high velocity (e.g., about 0.2 m/s or more). Thus, after having been teemed onto the shoot, the melt can reach the surface of the chill roller in a shorter time than the conventional strip casting process. Thus, the decrease in the temperature of the melt on the shoot can be reduced significantly. Accordingly, even if the melt has a relatively low temperature, the melt can still be fed at any desired temperature onto the chill roller. In addition, since the melt flows quickly on the shoot, the unwanted oxidation of the melt can be minimized and slag and other debris are unlikely to be collected in the shoot. When oxidized, the melt will have an increased viscosity to possibly clog the tubular holes up. However, according to preferred embodiments of the present invention, the melt can run down on the tilted guide surface quickly, the unwanted increase in the viscosity of the melt due to oxidation can be minimized, and clogging of the tubular holes rarely happens.

Hereinafter, specific examples of a method for producing a sintered magnet according to a preferred embodiment of the present invention will be described.

EXAMPLES

In the following specific examples of preferred embodiments of the present invention, a melt quenching machine such as that shown in FIG. 3 was also used. Specifically, first, the respective materials Nd, Dy, B, C and Fe with purities of about 99.5% or more were weighed such that the mixture had a total weight of about 4 kg and an alloy composition $Nd_{31.1}Dy_{1.0}B_{1.1}C_{3.0}Fe_{63.9}$ (where the subscripts indicate weight percentages). Then, the mixture was injected into a crucible of alumina.

Next, the material alloy was melted by a high frequency heating process in the alumina crucible, thereby obtaining a molten alloy having the composition described above. The molten alloy had a temperature of about 1,500° C. Thereafter, the alumina crucible was tilted to teem the molten alloy onto the guide surface of the shoot assembly.

A replaceable member with three tubular holes (each having a diameter of about 4 mm) was fitted in the bottom of the guide surface. Thus, the melt running down on the guide surface was converged by the tubular holes so as to be fed onto the surface of a chill roller that was rotating under the tubular holes.

Before the pseudo-tubular members started to grow, the tubular holes of the shoot had a length of about 10 mm. The distance between the end of the tubular holes and the surface of the chill roller was initially about 10 mm. The melt that had been emitted from the tubular holes was brought into contact with, and rapidly cooled and solidified by, the chill roller that was provided within an Ar atmosphere having a pressure of about 50 kPa. The chill roller was rotating at a peripheral velocity of about 2 m/s. The angles α, β and γ were defined at about 5 degrees, about 20 degrees and about 2 degrees, respectively. When the melt quenching process reached a steady state, the pseudo-tubular members had grown to a length of about 7 mm. As a result, the effective length of the tubular holes reached about 17 mm. Then, the distance between the end of the pseudo-tubular members and the surface of the chill roller was about 1.5 mm to about 3.0 mm.

In this specific example, three tubular holes were provided. Thus, three melt flows were fed onto the chill roller and three rapidly solidified alloys were formed simultaneously. The cast flakes of the rapidly solidified alloys obtained in this manner had widths of about 6 mm to about 10 mm and lengths of about 10 mm to about 300 mm.

Thereafter, 100 cast flakes were arbitrarily selected from the rapidly solidified alloys obtained in this manner, and the thicknesses thereof were measured. As a result, those cast flakes had an average thickness of about 230 μm with a standard deviation of about 20 μm. The crystal grains in the cast flakes had a minor-axis size of about 0.5 μm to about 7 μm and a major-axis size of about 3 μm to about 70 μm. The cast flakes had an alloy structure in which a main $R_2Fe_{14}B$ phase was surrounded with an R-rich phase with a thickness of about 0.5 μm to about 7.0 μm. The uniform dispersion of the R-rich phase was confirmed with an electron beam micro analyzer EPM-810 (produced by Shimadzu Corp).

The cast flakes were coarsely pulverized and then finely pulverized by known techniques, thereby obtaining a finely pulverized powder with a mean particle size of about 3.0 μm. Then, the finely pulverized powder was compacted under a magnetic field with a strength of about 1.20 MA/m and then sintered. The compacting pressure was about 100 MPa and the sintering process was carried out at about 1,060° C. for approximately 3 hours. The sintered compact was subjected to an aging treatment at about 600° C. for approximately one hour. The magnetic properties of the permanent magnet obtained in this manner are shown in Table 3.

Comparative Example

Figure 2:
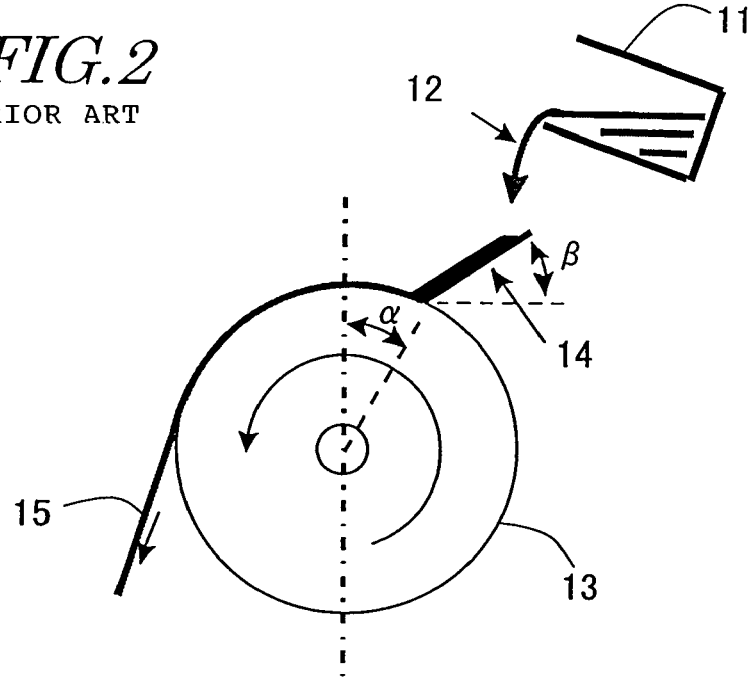
FIG.2 PRIOR ART
FIG. 2 is a schematic cross-sectional view illustrating an arrangement for a conventional strip caster.

A rapidly solidified alloy having the same alloy composition as the specific example described above was prepared by using the machine shown in FIG. 2 under almost the same conditions except that the melt was directly fed from the shoot onto the chill roller through no tubular holes. In this comparative example, the distance between the end of the shoot and the surface of the chill roller was about 10 mm, and the angles α and β were about 20 degrees and about 10 degrees, respectively.

In this manner, cast flakes of rapidly solidified alloys with widths of about 20 mm to about 30 mm and with lengths of about 10 mm to about 300 mm were obtained. Thereafter, 100 cast flakes were arbitrarily selected from the rapidly solidified alloys obtained in this manner, and the thicknesses thereof were measured. As a result, those cast flakes had an average thickness of about 240 μm with a standard deviation of about 64 μm.

The crystal grains in the cast flakes had a minor-axis size of about 0.5 μm to about 20 μm and a major-axis size of about 10 μm to about 300 μm. The cast flakes had an alloy structure in which a main $R_2Fe_{14}B$ phase was surrounded with an R-rich phase with a thickness of about 2.0 μm or less.

The cast flakes were also pulverized and then sintered under the same conditions as the specific example described above, thereby obtaining sintered magnets. The magnetic properties of the resultant permanent magnet are also shown in the following Table 3:

TABLE 3

| | $B_r$ (T) | $(BH)_{max}$ (kJ/m$^3$) | $H_{cJ}$ (MA/m) |
|---|---|---|---|
| Example | 1.28 | 353.2 | 1.61 |
| Comparative Example | 1.27 | 335.4 | 1.24 |

As can be seen from the results shown in Table 3, the maximum energy product and coercivity of the specific example of preferred embodiments of the present invention were higher than those of the comparative example. These results reveal that a highly uniform magnetic alloy structure was obtained in the specific example of preferred embodiments of the present invention because the degree of contact between the molten alloy and the chill roller was increased so significantly that the molten alloy must have been quenched uniformly enough.

According to various preferred embodiments of the present invention described above, a melt puddle can be formed constantly even on a chill roller that is rotating at a relatively high velocity. Thus, the present invention effectively contributes to mass-producing rapidly solidified alloys for not just nanocomposite magnets but also other types of magnets.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A method of making a rapidly solidified alloy for a nanocomposite magnet, the method comprising the steps of:

preparing a melt of an alloy having a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element; and M is at least one metal element selected from the group consisting of Al, Si, Ti, V, Cr, Mn, Cu, Zn, Ga, Zr, Nb, Mo, Ag, Hf, Ta, W, Pt, Au and Pb, the mole fractions x, y, z and m satisfying the inequalities of:

10 at %≦x≦35 at %;

2 at %≦y≦10 at %;

0 at %≦z≦10 at %; and

0≦m≦0.5, respectively, and forming the rapidly solidified alloy by bringing the melt into contact with the surface of a rotating chill roller; wherein the step of forming the rapidly solidified alloy includes the steps of:

arranging a guide member such that a guide surface thereof defines a tilt angle of about 5 degrees to about 70 degrees with respect to a horizontal plane, the guide member having a plurality of tubular holes with at least one of the plurality of tubular holes having a length of about 0.5 mm to about 50 mm and an opening area of about 0.02 cm$^2$ to about 0.5 cm$^2$;

teeming the melt onto the guide surface of the guide member, and then feeding the melt, running down on the guide surface, through the plurality of tubular holes of the guide member directly adjacent to the guide surface and onto a contact area on the surface of the chill roller; and splitting the melt into a number of melt flows by way of the plurality of tubular holes and then bringing the melt flows into contact with the chill roller.

2. The method of claim 1, wherein the step of forming the rapidly solidified alloy includes the step of arranging the guide member such that an angle α of about 0 degrees to about 80 degrees is defined, in a direction opposite to a rotating direction of the chill roller, between a vertical plane and a line that connects a point on the surface of the chill roller, at which the melt contacts with the chill roller for the first time, and an axis of rotation of the chill roller.

3. The method of claim 1, wherein the step of forming the rapidly solidified alloy includes the step of arranging the guide member such that a distance of about 0.3 mm to about 50 mm is provided between the end of the at least one tubular hole and the surface of the chill roller.

4. The method of claim 1, wherein the step of forming the rapidly solidified alloy includes the step of arranging the guide member such that an angle γ of about −20 degrees to about 40 degrees is defined between a flowing direction of the melt that has just been emitted out of the at least one tubular hole and a line that connects the center of an inlet opening of the at least one tubular hole and the axis of rotation of the chill roller, where the angle γ is positive if the melt flowing direction is opposite to the rotating direction of the chill roller and is negative if the melt flowing direction is identical to the rotating direction of the chill roller.

5. The method of claim 1, wherein the step of forming the rapidly solidified alloy includes the step of providing the guide member having a structure that supports a member including the at least one tubular hole in an attachable and removable state.

6. The method of claim 1, wherein the step of forming the rapidly solidified alloy includes the step of obtaining a rapidly solidified alloy, having an average thickness of more than about 50 μm to about 150 μm with a standard deviation of at most about 10 μm, by teeming the melt onto the guide surface at a rate of at least about 1.5 kg/min and then allowing the melt to run down on the guide surface with the upper surface of the melt exposed to an atmosphere.

7. The method of claim 6, wherein the step of forming the rapidly solidified alloy includes the step of bringing the melt into contact with the surface of the chill roller within a reduced pressure atmospheric gas.

8. The method of claim 7, wherein the step of bringing the melt into contact with the chill roller includes the step of controlling the pressure of the atmospheric gas at about 0.13 kPa to about 100 kPa.

9. A method of making a nanocomposite magnet powder, the method comprising the steps of:

preparing the rapidly solidified alloy for a nanocomposite magnet by the method of claim 1; and pulverizing the rapidly solidified alloy.

10. The method of claim 9, further comprising the step of conducting a heat treatment process for crystallization purposes before and/or after the step of pulverizing the rapidly solidified alloy is performed.

11. A method for producing a nanocomposite magnet, the method comprising the steps of:

preparing a nanocomposite magnet powder by the method of claim 9; and compacting the nanocomposite magnet powder into a magnet shape.

12. A method of making a rapidly solidified alloy for a permanent magnet, the method comprising the steps of:

preparing a melt of an alloy; and forming the rapidly solidified alloy by bringing the melt into contact with the surface of a rotating chill roller; wherein the step of forming the rapidly solidified alloy includes the steps of:

arranging a guide member such that a guide surface thereof defines a tilt angle of about 5 degrees to about 70 degrees with respect to a horizontal plane, the guide member having a plurality of tubular holes with at least one of the plurality of tubular holes having a length of about 0.5 mm to about 50 mm and an opening area of about 0.03 $cm^2$ to about 0.6 $cm^2$, and arranging the guide member such that a distance of about 1 mm to about 50 mm is provided between the end of the at least one tubular hole and the surface of the chill roller;

teeming the melt onto the guide surface of the guide member, and then feeding the melt, running down on the guide surface, through the plurality of tubular holes of the guide member directly adjacent to the guide surface and onto a contact area on the surface of the chill roller; and splitting the melt into a number of melt flows by way of the plurality of tubular holes and then bringing the melt flows into contact with the chill roller.

13. The method of claim 12, wherein the step of forming the rapidly solidified alloy includes the step of arranging the guide member such that an angle $\alpha$ of about 5 degrees to about 80 degrees is defined in a direction opposite to a rotating direction of the chill roller between a vertical plane and a line that connects a point on the surface of the chill roller, at which the melt contacts with the chill roller for the first time, and the axis of rotation of the chill roller.

14. The method of claim 12, wherein the step of forming the rapidly solidified alloy includes the step of rapidly cooling and solidifying the surface of the melt flow that has been emitted out of the tubular hole, thereby making a tubular member from the melt flow and extending an effective length of the tubular hole to about 10 mm or more.

15. The method of claim 12, wherein the step of forming the rapidly solidified alloy includes the step of allowing the melt to run down on the guide surface with the upper surface of the melt exposed to an atmosphere and filling the tubular hole with the melt flow.

16. The method of claim 15, wherein the step of forming the rapidly solidified alloy includes the step of obtaining a rapidly solidified alloy, having an average thickness of more than about 50 μm to about 150 μm with a standard deviation of at most about 10 μm, by teeming the melt onto the guide surface at a rate of at least about 1.5 kg/min.

17. The method of claim 12, wherein the step of forming the rapidly solidified alloy includes the step of bringing the melt into contact with the surface of the chill roller within a reduced pressure atmospheric gas while substantially equalizing the pressure of the atmospheric gas on the surface of the melt running down on the guide surface with that of the atmospheric gas on the surface of the melt that has been emitted out of the tubular hole.

18. A method of making a magnet powder, the method comprising the steps of:

preparing the rapidly solidified alloy for a magnet by the method of claim 12; and pulverizing the rapidly solidified alloy.

19. The method of claim 18, further comprising the step of conducting a heat treatment process for crystallization purposes before and/or after the step of pulverizing the rapidly solidified alloy is performed.

20. A method for producing a magnet, the method comprising the steps of:

preparing a magnet powder by the method of claim 18; and compacting the magnet powder to obtain a bonded magnet.

21. A method for producing a magnet, the method comprising the steps of:

preparing a magnet powder by the method of claim 18; and sintering the magnet powder to obtain a sintered magnet.

* * * * *